US005443089A

United States Patent [19]

Haumann

[11] Patent Number: 5,443,089

[45] Date of Patent: Aug. 22, 1995

[54] HYDRAULIC AMPLIFIERS WITH REDUCED LEAKAGE AT NULL

[75] Inventor: Anton Haumann, Ehningen, Germany

[73] Assignee: Moog Inc., East Aurora, N.Y.

[21] Appl. No.: 217,193

[22] Filed: Mar. 23, 1994

[51] Int. Cl.[6] ..... F15B 5/00

[52] U.S. Cl. ..... 137/82; 137/83

[58] Field of Search ..... 137/82, 83, 625.69

[56] References Cited

U.S. PATENT DOCUMENTS

| | | | |
|---|---|---|---|
| 2,798,461 | 7/1957 | Gold | 1317/625.69 |
| 2,881,740 | 4/1959 | Ensinger | 137/82 UX |
| 2,919,681 | 1/1960 | Shultz | 137/625.69 |
| 2,931,343 | 4/1960 | Moog | 137/82 X |

*Primary Examiner*—Robert G. Nilson
*Attorney, Agent, or Firm*—Phillips, Lytle, Hitchcock, Blaine & Huber

[57] ABSTRACT

An improved fluid amplifier (39) is operatively arranged in a flow path extending between a source (28, 31) of pressurized fluid ($P_s$) and a fluid return (38) at a return pressure (R). The amplifier has at least one fluid connection (34 or 35) to a load. The amplifier has a movable mechanical member (24) operatively arranged to control the pressure at, and flow with respect to, the load. The mechanical member has a displacement range encompassing a null position and an off-null position. The improvement broadly includes a variable-impedance orifice (42 and/or 43) arranged in series with the amplifier in the low path. The impedance of the orifice is varied such that the impedance is a maximum when the mechanical member is in the null position and is a minimum when the mechanical member is in off-null position, such that flow from the supply to the return when the mechanical member is in the null position will be less than the maximum flow between the amplifier and the load.

10 Claims, 4 Drawing Sheets

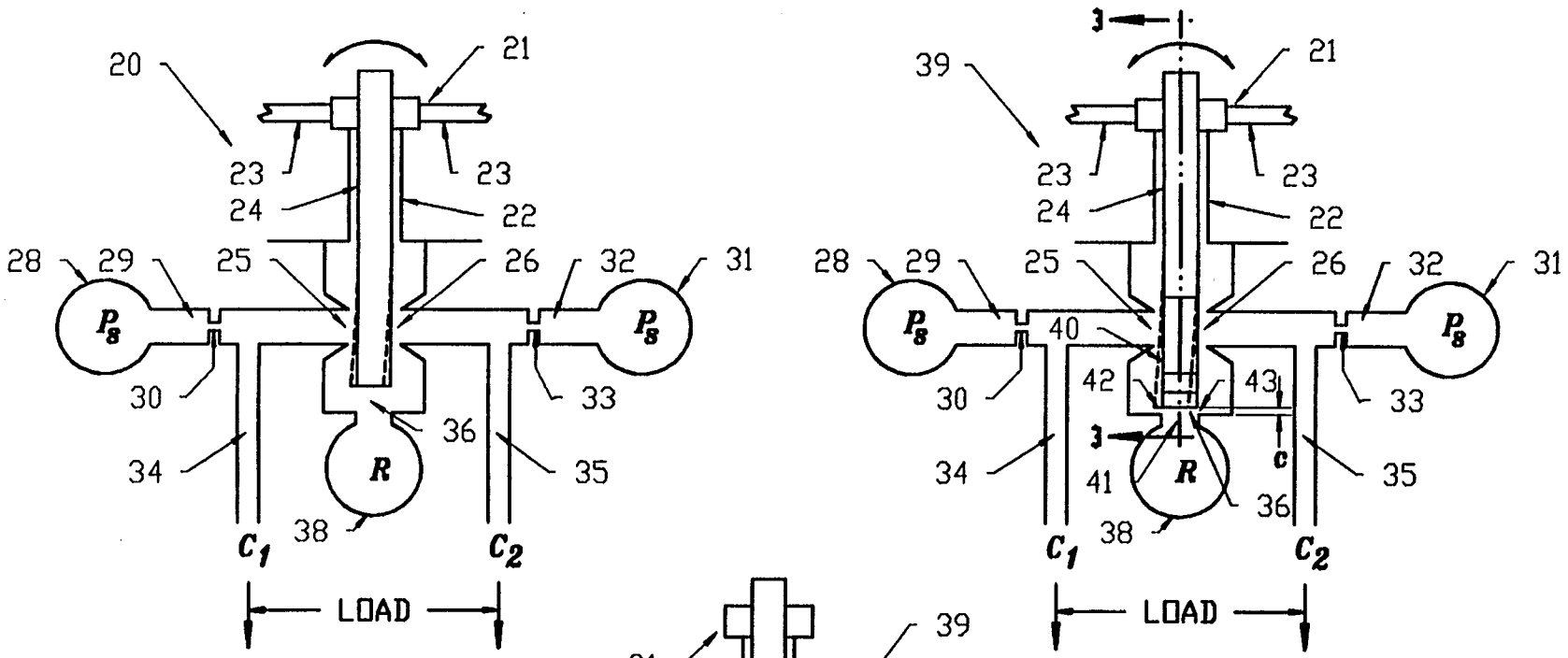
Fig. 1
(PRIOR ART)
Fig. 2
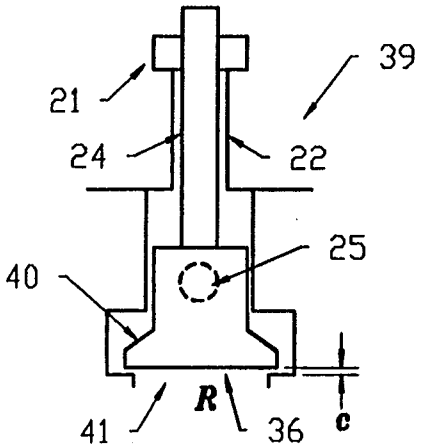
Fig. 3

HYDRAULIC AMPLIFIERS WITH REDUCED LEAKAGE AT NULL

TECHNICAL FIELD

The present invention relates generally to the field of hydraulic amplifiers, and, more particularly, to improved hydraulic amplifiers that exhibit reduced leakage characteristics at null and that are particularly suited for use in electrohydraulic servovalves.

BACKGROUND ART

A hydraulic amplifier may be generally regarded as a hydro-mechanical device in a which small-amplitude, low-force mechanical displacement of a member is used to provide a high response modulation in hydraulic power. The motion of the member may be caused by a suitable electro-mechanical device, such as a torque or force motor.

Such amplifiers are commonly used in electrohydraulic servovalves of the single-stage or two-stage type. In a single-stage or direct-drive servovalve, the hydraulic output of the amplifier communicates directly with the load. In a two-stage servovalve, the amplifier is typically used as a pilot-stage to selectively displace a second-stage valve spool relative to a body. In this case, the first-stage amplifier is used to create a pressure differential which is applied to the spool end areas. Displacement of the second-stage spool is used to vary orifices through which fluid may respectively flow from source to the load and from the load to the return. Thus, in a single-stage servovalve, the hydraulic output of the amplifier communicates directly with the load, whereas in a two-stage servovalve, the amplifier output is used to controllably move a spool to vary second-stage orifices through which fluid may flow with respect to the load.

In a single-stage servovalve, the movable member is typically a jet-pipe or a jet-deflector, such as representatively shown and described in U.S. Pat. No. 3,542,051 and 4,442,855. In a two-stage servovalve, the member may be a flapper arranged between two opposed nozzles, such as shown and described in U.S. Pat. No. 3,023,782 and 3,612,103. The aggregate disclosures of these patents are incorporated by reference herein insofar as a description of the structure and operation of such prior art devices is concerned.

In either case, pressurized hydraulic fluid continuously flows through the amplifier, and is available to do the commanded work. When the member is displaced off-null, the fluid parameters (i.e., pressure, flow, etc.) must be adequate for the intended purpose. However, when the member is returned to a null or centered position, fluid still flows through the amplifier. Thus, the amplifier consumes power while in a standby condition.

Therefore, it would be desirable to improve the efficiency of such a hydraulic amplifier by reducing the power consumed due to leakage flow when the member is in a null position, while continuing to afford adequate power capability for commanded off-null applications.

DISCLOSURE OF THE INVENTION

With parenthetical reference to the corresponding parts, portions or surfaces of the first disclosed embodiment, merely for purposes of illustration and not by way of limitation, the present invention provides an improved fluid amplifier (39) operatively arranged in a flow path (29, 32) extending between a source (28, 31) of pressurized fluid at a supply pressure ($P_S$), and a fluid return (38) at a return pressure (R). The amplifier has at least one fluid connection (34 and/or 35) to a load, and has a movable member operatively arranged to control the pressure(s) at, and flow(s) with respect to, the load. The member has a permissible displacement range that encompasses a first position (e.g., a null position) and a second position (e.g., a commanded off-null position). The improvement broadly includes a variable-impedance orifice (42 and/or 43) arranged in series with the amplifier in the flow path between supply and return (i.e., between the fluid source and the amplifier, or between the amplifier and the fluid return). The impedance of this orifice is varied such that it is a maximum when the member is in the first position, and is a minimum when the member is in the second position. Thus, when the movable member is in the first position, flow from supply to return is less than the maximum flow between the amplifier and the load.

Accordingly, the general object of the invention is to provide improved hydraulic amplifiers that are more efficient in standby situations.

Another object is to provide improved hydraulic amplifiers for use in servovalves.

Another object is to provide improved hydraulic amplifiers in which a member is movable within a permissible displacement range which encompasses a null position and an off-null position, and wherein the leakage flow of fluid through the amplifier is substantially reduced when the member is in the null position.

Another object is to provide such a reduced null-leakage amplifier, which nevertheless affords adequate power capability when the member is moved off-null.

These and other objects and advantages will become apparent from the foregoing and ongoing written specification, the drawings, and the appended claims.

BRIEF DESCRIPTION OF THE DRAWINGS

FIG. 1 is a fragmentary longitudinal vertical structural schematic of a prior art nozzle-flapper amplifier.

FIG. 2 is a fragmentary longitudinal vertical structural schematic of an improved low-leakage nozzle-flapper amplifier.

FIG. 3 is a fragmentary transverse vertical structural schematic view thereof, taken generally on line 3—3 of FIG. 2.

DESCRIPTION OF THE PREFERRED EMBODIMENTS

Figure 5:
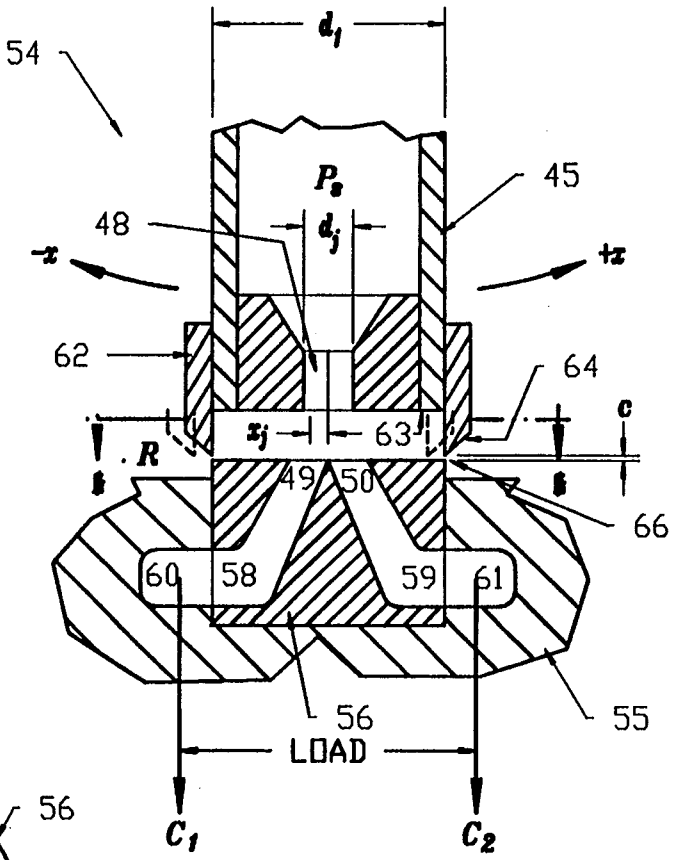
FIG. 5 is a fragmentary longitudinal vertical structural schematic of an improved low-leakage jet-pipe amplifier.

At the outset, it should be clearly understood that like reference numerals are intended to identify the same structural clements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, the present invention broadly provides improved fluid amplifiers that offer the desirable feature of reducing leakage through the amplifier when a member (e.g., a flapper, a jet-pipe, a jet-deflector, etc.) is in a centered or null position relative to a cooperative pair of discharge nozzles or receiver openings, as appropriate. While the improved amplifiers are particularly suited for use in electrohydraulic servovalves of the three-way and four-way type, it should be clearly understood that these applications are merely illustrative and are not intended to limit the scope of the appended claims. Thus, the improved amplifiers may be used in other applications and environments as well.

For the convenience of the reader, three specific implementations of the improved amplifiers will be discussed seriatim herebelow.

Nozzle-Flapper Arrangement (FIGS. 1–3)

FIG. 1 schematically depicts the structure of a conventional nozzle-flapper amplifier, generally indicated at 20. This type of amplifier is commonly used as the pilot-stage of a two-stage electrohydraulic servovalve, such as fully shown and described in U.S. Pat. No. 3,023,782, supra.

Amplifier 20 is shown as having a T-shaped armature-flapper member 21 mounted on the upper end of a flexure tube 22 that sealingly separates an electrical section (not fully shown) outside the tube from a hydraulic section within the tube. Member 21 has two laterally-extending horizontal arms, fragmentary portions of which are severally indicated at 23, having their marginal end portions (not shown) arranged between the polepieces (not shown) of a torque motor (not shown). A cantilevered flapper 24 extends downwardly from the armature so that a portion of the flapper is arranged for pivotal movement between opposed left and right nozzles 25, 26, respectively.

Pressurized hydraulic fluid at supply pressure $P_s$ is provided from a source 28 to left nozzle 25 through a conduit 29 containing a restricted orifice 30 of fixed impedance. Similarly, pressurized hydraulic fluid, again at supply pressure $P_s$, is provided from a source 31 to right nozzle 26 through a conduit 32 containing a restricted orifice 33 of fixed impedance. Fluid sources 28, 31 may, for all intents and purposes, be the same, and the impedances of fixed orifices 30, 33 may be the same.

Branch conduit 34 communicates with left conduit 29 between orifice 30 and nozzle 25, and provides a first variable control pressure at left outlet port $C_1$. Conversely, branch conduit 35 communicates with right conduit 32 between orifice 33 and right nozzle 26, and provides a second variable control pressure at right outlet port $C_2$. Passageways 34, 35 communicate with opposing chambers of a fluid-powered load through control ports $C_1$, $C_2$. Fluid is discharged from opposed nozzles 25, 26 into a common chamber 36 that communicates with a fluid return 38 at a return pressure R.

Persons skilled in this art will appreciate that a hydraulic schematic of the amplifier shown in FIG. 1 somewhat resembles a Wheatstone bridge, as generally shown in FIG. 3 of U.S. Pat. No. 3,257,911, the aggregate disclosure of which is hereby also incorporated by reference. Pivotal movement of the armature from a centered or null position between the nozzles causes the flapper to move closer to one nozzle and farther from the other, as schematically suggested by the dashed lines in FIG. 1. The position of the flapper relative to the nozzles varies differentially the pressures available at control ports $C_1$ and $C_2$. In other words, as the flapper moves from a centered or null position toward one nozzle and farther from the other, the pressure in the proximate branch conduit will increase while the pressure in the distant branch conduit will decrease, and vice versa. Thus, the pressure differential between outlet ports $C_1$ and $C_2$ is available to do usable work with respect to the load.

The nozzle-flapper amplifier shown in FIG. 1 is in common use in two-stage electrohydraulic servovalves (see, e.g., U.S. Pat. No. 3,023,782, supra) and in single-stage servovalves as well (see, e.g., U.S. Pat. No. 3,455,330). However, this type of amplifier permits a continuous flow of pressurized fluid from the source(s) to return, even when the flapper is at null and it is not desired to do any work with respect to the load. Therefore, this null leakage flow continues when the amplifier is in a standby condition relative to the load, and reduces the overall efficiency of the valve because pressurized fluid must be continuously supplied to the amplifier.

An improved nozzle-flapper amplifier is generally indicated at 39 in FIG. 2. The improved amplifier uses many of the same parts and components as the conventional arrangement shown in FIG. 1. Hence, the same reference numerals have again been used in FIG. 2 to identify like structure previously described, and the improved amplifier will now be described to the extent that it differs from that shown in FIG. 1.

The salient difference is that a specially-configured member 40 is mounted on the lower marginal end portion of the flapper to cooperate with a rectangular slot-like passageway 41 communicating chamber 36 with the fluid return 38. As shown in FIG. 2, the width of member 40 is substantially equal to the width of slot 41. Thus, member 40 is substantially zero-lapped with respect to the width of slot 41. However, as shown in FIG. 3, member 40 is overlapped with respect to the length of slot 41. Moreover, the lower end face of member 40 is spaced above the open mouth of slot 41 by a vertical clearance c. Thus, member 40 defines with slot 41 a pair of sharp-edged orifices 42, 43. Movement of the flapper off-null causes the lower end face of the flapper to be overlapped with respect to one longitudinal edge of slot 41 (thereby increasing the impedance of its associated orifice), while causing the lower end face of the flapper to be underlapped with respect to the other longitudinal edge of slot 41 (thereby decreasing the impedance of its associated orifice). Thus, for all intents and purposes, such movement causes the underlapped orifice to open, thereby reducing the impedance of the flow from chamber 36 to return. However, when the flapper returns to its null position, member 40 is positioned immediately over slot 41, again causing the lower end face of the flapper to be zero-lapped with respect to the longitudinal edges of slot 41, thereby substantially reducing the leakage flow through the amplifier. Therefore, the improved nozzle-flapper amplifier 39 offers the desirable feature of reduced leakage when the flapper is at null, with availability of power to the load when the flapper is moved off-null in the appropriate direction.

Figure 6:
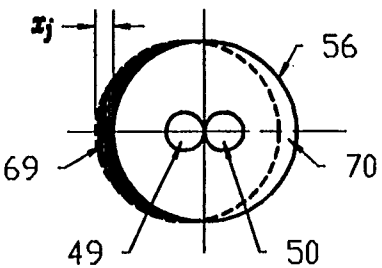
FIG. 6 is a fragmentary transverse horizontal structural schematic view thereof, taken generally on line 6—6 of FIG. 5, showing the crescent-shaped opening to return when the jet-pipe is displaced off-null.
Figure 4:
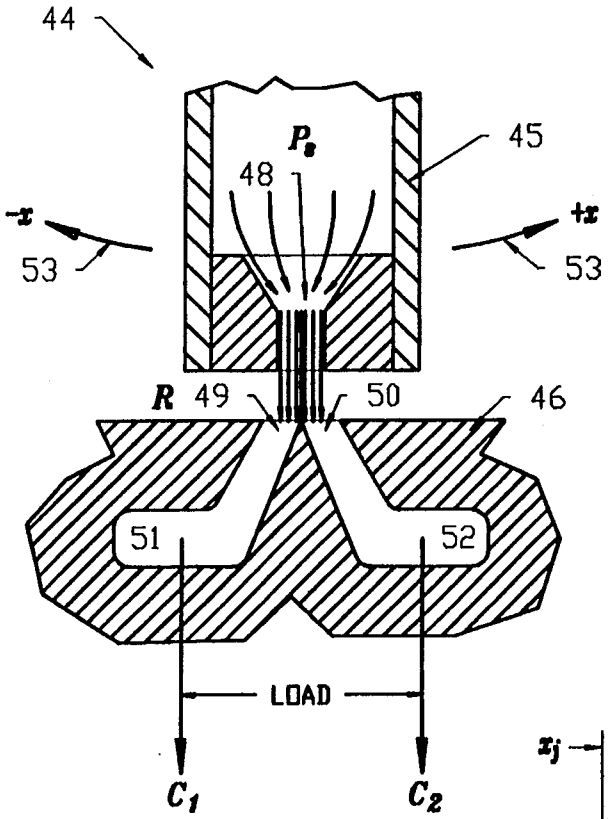
Fig. 4 (PRIOR ART)
FIG. 4 is a fragmentary longitudinal vertical structural schematic of a prior art jet-pipe amplifier.

Jet-Pipe Arrangement (FIGS. 4–6)

The fundamental principles of the invention may be applied to a jet-pipe amplifier as well.

FIG. 4 is a fragmentary vertical structural schematic of a portion of a conventional jet-pipe amplifier, generally indicated at 44. Amplifier 44 includes a pipe or tube 45 mounted for pivotal movement with respect to a body 46. The position of the jet-pipe might be controlled by a torque motor (not shown) or the like. Pressurized fluid at a supply pressure $P_s$ is supplied to the interior of pipe 45 from a suitable source (not shown), and is discharged downwardly through a fixed impedance nozzle 48 in the lower marginal end portion of the pipe, toward the open mouths 49, 50 of a pair of receiver passages 51, 52, respectively, provided in the body. These receiver passages communicate with a load via outlet ports $C_1$, $C_2$, respectively. The lower end face of pipe 45 is spaced above the planar upper horizontal surface of body 46. Thus, fluid is discharged from pipe 45 as a jet toward the body. The discharged jet divides between receiver openings 49, 50, to create momentum flows in passageways 51, 52, respectively. The differential of these momentum flows is used at the load.

When the pipe is in its null or centered position, the discharged jet divides equally between the receiver openings 49, 50. However, when the pipe is moved off-null in the appropriate direction as indicated by arrows 53, the discharged jet will divide unequally between the receiver openings. In this event, the momentum flow of fluid in one passageway will be greater than the momentum flow in the other passageway, and the differential of such momentum flows can be used to act upon the load. It should also be noted that the space between pipe 45 and body surface 46 continuously communicates with a fluid return at a return pressure R. Thus, with this prior art jet-pipe amplifier 44, even when the pipe member is in its centered or null position with respect to the body, so that the discharged jet divides evenly between the receiver openings, there is substantial flow through the amplifier.

An improved jet-pipe amplifier is generally indicated at 54 in FIG. 5. Since the improved amplifier uses many of the same parts and components as in the prior art arrangement, the same reference numerals have again been used to identify the same structure previously described, and new reference numerals are reserved for additional or supplementary structure.

The improved amplifier again has a pipe 45 provided with a fixed-impedance nozzle or orifice 48 at its lower marginal end, through which fluid will be discharged downwardly. The body 46 has been replaced by a body 55 having a vertically-elongated cylindrical plug 56 mounted therein. The planar horizontal upper end surface of plug 56 is spaced above the upper surface of the surrounding body. Plug 56 has side-by-side receiver openings 49, 50, which communicate via plug passages 58, 59 with body passageways 60, 61, respectively. Passageways 60, 61 communicate via control ports $C_1$, $C_2$ with a load.

An annular sleeve member 62 is mounted on the lower marginal end portion of tube 45 and extends downwardly below the lower end face thereof. Sleeve member 62 is shown as having a downwardly- and outwardly-facing frusto-conical surface 64 extending between its inner and outer vertical cylindrical surfaces. The sharpened edge defined between surface 64 and the sleeve inner surface, is spaced above the plug upper surface by a vertical clearance c. The outer surface of pipe 45, the inner surface of sleeve 62, and the outer diameter of plug 56, are all shown as being of diameter $d_l$. Orifice 48 is shown as having a diameter $d_j$.

In the improved arrangement, sleeve 62 defines with receiver plug 56 an annular sharp-edged orifice 66 therebetween. The impedance of this orifice varies as a function of the position of pipe 45 relative to plug 56. When the pipe is in its centered or null position relative to receiver plug 56, as shown in FIG. 1, the sharpened sleeve edge is positioned immediately overhead the outer annular edge of receiver plug 56. Thus, sleeve 62 is zero-lapped with respect to plug 55 when pipe 45 is in its centered or null position above the receiver plug, and the impedance of orifice 66 is at its maximum value.

When tube 45 is displaced to an off-null position, as represented by dimension $x_j$, as indicated by the dashed lines in FIG. 5, the fluid jet will divide unevenly between the receiver openings. At the same time, the skirt 62 will not be zero-lapped with respect to the receiver plug. Rather, the now-displaced pipe will create a crescent-shaped underlapped opening 69 communicating with the return, while creating a diametrically-opposite crescent-shaped overlapped portion 70. The impedance of crescent-shaped opening 69 is substantially less than the impedance of the zero-lapped null orifice 66. Since the null leakage of the amplifier must pass through annular orifice opening 66 or crescent-shaped opening 69, the leakage will be significantly throttled near null, and allowed to increase away from null, thereby increasing the jet momentum flow to produce the desired load flow. While unidirectional off-null motion of the member has been shown and described, persons skilled in this art will readily appreciate that the member may be alternatively moved in the opposite direction.

Therefore, in the second embodiment, the improved amplifier offers the feature of reduced leakage when the pipe is at null, while still affording the capability of power availability when the pipe is moved off-null.

Figure 8:
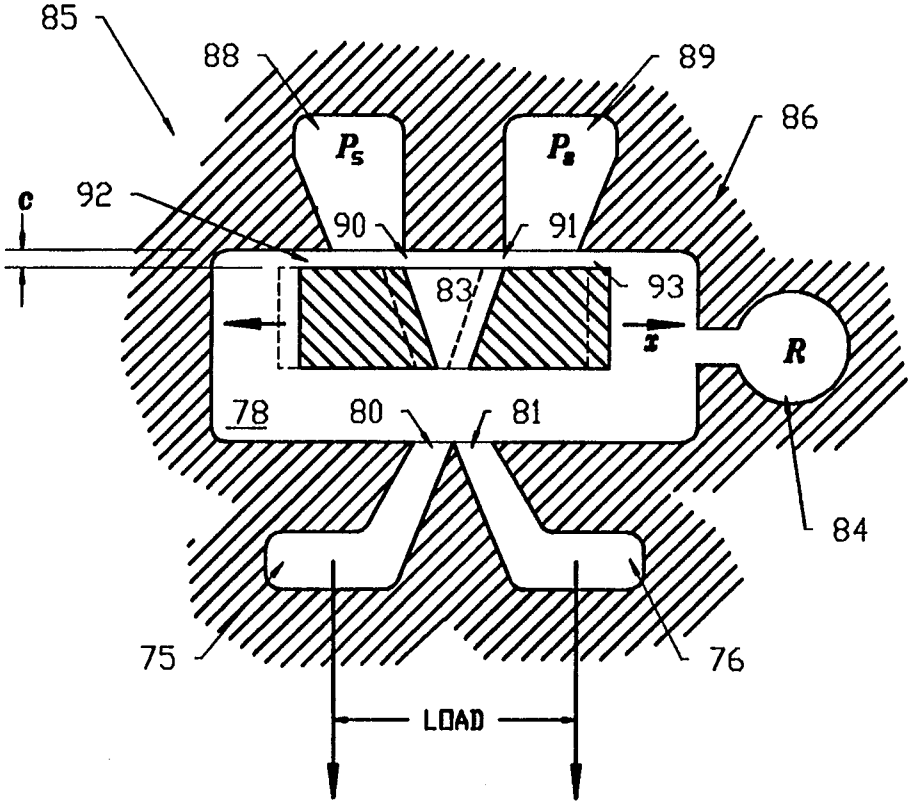
FIG. 8 is a fragmentary longitudinal vertical structural schematic of a first form of an improved low-leakage jet-deflector amplifier.
Figure 7:
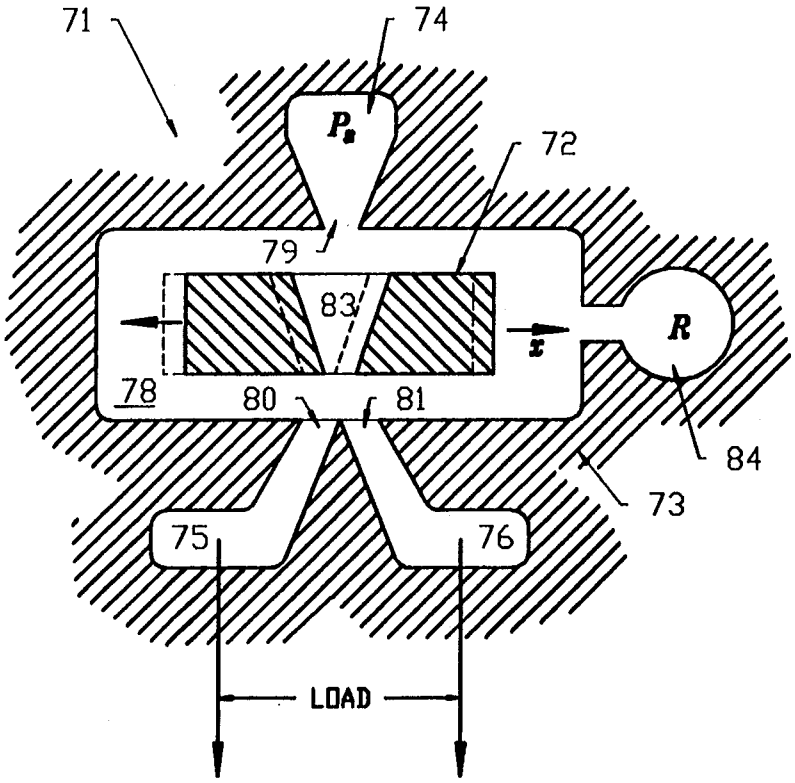
Fig. 7 (PRIOR ART)
FIG. 7 is a fragmentary longitudinal vertical structural schematic of a prior art jet-deflector amplifier.
Figure 12:
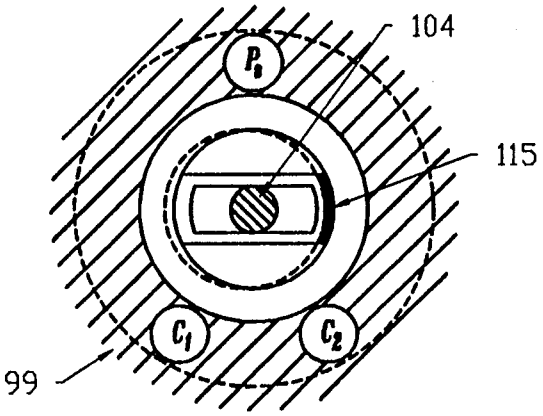
FIG. 12 is a fragmentary transverse horizontal sectional view thereof, taken generally on line 12—12 of FIG. 9.
Figure 11:
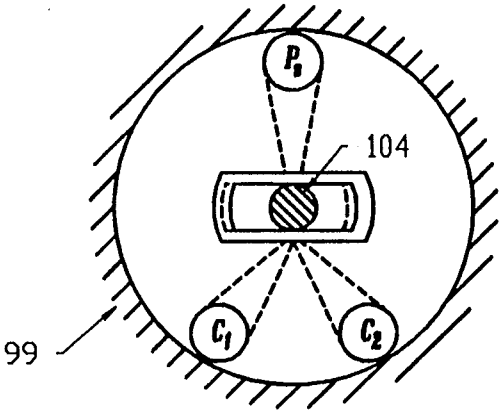
FIG. 11 is a fragmentary transverse horizontal sectional view thereof, taken generally on line 11—11 of FIG. 9.
Figure 9:
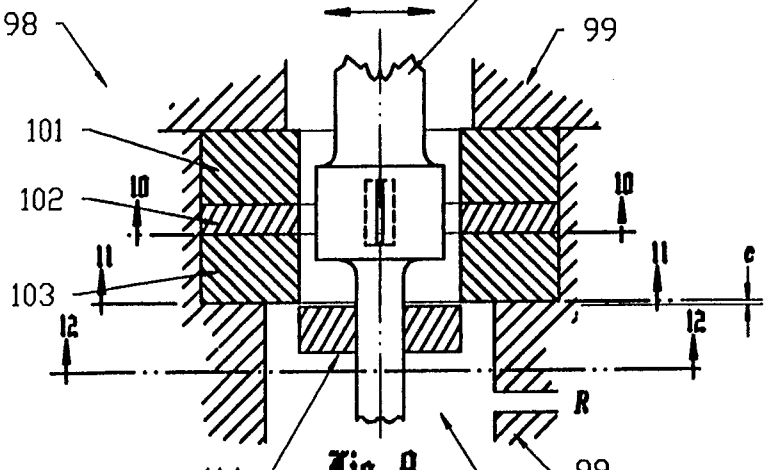
FIG. 9 is a fragmentary longitudinal vertical structural schematic of a second form of an improved low-leakage jet-deflector amplifier.
Figure 10:
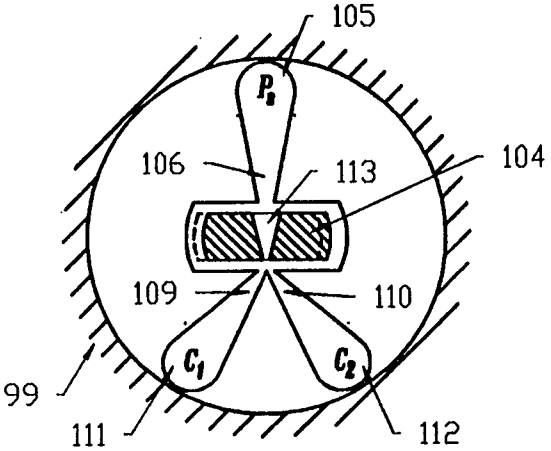
FIG. 10 is a fragmentary transverse horizontal sectional view thereof, taken generally on line 10—10 of FIG. 9.

First Jet-Deflector Arrangement (FIGS. 7–8)

The fundamental principle of the invention may also be applied to a jet-deflector amplifier.

FIG. 7 schematically depicts portions of a conventional jet-deflector amplifier, as more fully shown in U.S. Pat. Nos. 3,542,051, 4,442,855 and 3,612,103, supra. In FIG. 7, the prior art amplifier, generally indicated at 71, is shown as having a deflector member 72 movably mounted within a specifically-configured passageway provided in a body 73. The passageway somewhat resembles a stick-man having a head portion 74, two leg portions 75, 76, and a substantially-rectangular horizontally-elongated torso-and-arm portion 78. Pressurized fluid at a supply pressure $P_s$ is supplied from a suitable source (not shown) to the head portion 74, and is discharged through a fixed-impedance neck orifice or nozzle 79, having a rectangular cross-section, into passageway portion 78 and toward the leg portions. The leg portions 75, 76 have rectangular receiver openings 80, 81, respectively, arranged opposite, and bisecting the discharge axis of, the neck orifice. These receiver openings communicate via passageway portions 75, 76 with the load.

The deflector member 72 is positioned within the opening center portion 78 for horizontal movement relative thereto along in either direction, as indicated by the arrows. Such movement of the deflector relative to the body may be controlled by a suitable torque or force motor (not shown). In any event, the deflector member 72 is a horizontally-elongated substantially-rectangular member having a tapered slot-like opening 83 extending between its upper and lower horizontal surfaces. The wide upper open mouth of opening 83 is arranged to receive fluid discharged through neck opening 79, and the narrow lower portion of opening 83 is arranged to discharge fluid toward receiver openings 80, 81.

When the deflector member is in its centered or null position, the axis of deflector opening 83 is vertically aligned with the axis of the jet discharged from neck orifice 79, and is also aligned with a point between receiver openings 80, 81. Thus, a jet of fluid discharged through neck nozzle 79 and deflector orifice 83 will divide equally between receiver openings 80, 81 to create equal momentum flows in passageways 75, 76, respectively. On the other hand, if the deflector member is displaced off-null, as indicated by the dashed lines in FIG. 7, the fluid passing through deflector opening 83 will divide unequally between the receiver openings, and the differential of the momentum flows in passageways 75, 76 may be applied to the load. Opening 78 is shown as continuously communicating with a fluid return 84 at a return pressure R.

With this prior art arrangement, there was substantial flow through the amplifier even when the deflector member was in its centered or null position. If it was not desired to do useable work with respect to the load, the pressures in passageways 75, 76 would quickly build up, and additional fluid discharged from the source through neck nozzle 79 would flow directly to the return 84.

FIG. 8 is a fragmentary vertical structural schematic of a first form of an improved jet-deflector amplifier, generally indicated at 85. This improved amplifier also has a deflector member 72 arranged within the arm-and-torso portion 78 of a specifically-configured opening provided in a body 86. The body again has receiver openings 80, 81 which communicate with the load via passageway 75, 76, respectively. However, in the improved arrangement, rather than having a single head, the passageway is shown as having two horizontally-spaced heads, indicated at 88, 89, respectively. These two supply passages are separated from one another by a horizontal distance equal to the width of the entrance mouth of deflector opening 83. Moreover, in the improved amplifier, the deflector member is positioned more closely to the neck portion than in the prior art arrangement. Indeed, in the improved valve, the deflector is shown as being spaced from the supply openings by a clearance distance c.

Thus, when the deflector is in its centered or null position, as shown in FIG. 8, the open mouth of deflector passage 83 is substantially zero-lapped with respect to the next portions of the supply openings. This defines sharp-edged orifices 90, 91 between the supply openings and the jet-deflector passageway 83. Thus, at null, the flow of fluid through the amplifier will be reduced because of zero-lapped inboard orifices 90, 91, respectively. However, if the deflector is moved leftwardly off-null, as suggested by the dashed lines in FIG. 8, orifice 90 will be under-lapped, to allow jet flow from left head 88 through jet-deflector opening 83 toward the receiver openings 80, 81, and right orifice 91 will be overlapped. Conversely, should the jet-deflector move rightwardly off-null, the opposite effect would obtain.

Second Jet-Deflector Arrangement (FIGS. 9–12)

FIGS. 9–12 illustrate a second form of an improved jet-deflector amplifier, generally indicated at 98. This amplifier is shown as including a body 99 having a vertical passageway 100 provided with a radially-enlarged intermediate portion. Three disks, severally, indicated at 101, 102 and 103, respectively, are compressively sandwiched between opposed facing surfaces of the body. A movable deflector member, generally indicated at 104, is arranged in passageway 100 for generally horizontal movement relative thereto. Member 104 may be selectively moved by means of a force motor (not shown) or a torque motor (not shown).

The three disks have specially-configured openings and passageways that cooperate to form a stickman-like internal shape or character. This shape has a single head portion 105, a neck portion 106, a horizontally-elongated trunk-and-arm portion 108, two receiver openings 109, 110, and two leg portions 111, 112, respectively. The head portion is supplied with pressurized fluid at supply pressure $P_s$ from a suitable source (not shown), and the two leg portions communicate with control ports $C_1$ and $C_2$, respectively. The deflector member is further shown as having a tapered slot-like opening 113.

Fluid as supply pressure $P_s$ is provided to the head portion, and is discharged through the neck portion nozzle and through deflector member opening 113 toward receiver openings 109, 110. Deflector member 104 may be selectively moved in either direction so as to vary the relative momentum flows entering receiver openings 109, 110. Passageway 100 communicates with a lower fluid return at a return pressure R.

In this form, an annular disk-like member 114 is mounted on the movable member immediately below lower disk 103. Member 114 is arranged to be substantially zero-lapped with respect to the lower disk opening when the member is in its null position such that opening 113 is normally centered between the two receiver openings. Member 114 is spaced from the lower surface of disk 103 by a vertical clearance distance c. Thus, when the member is in its null position, the zero-lapped disk member 114 will restrict the flow of fluid to return. However, when the member is moved off null, one crescent-shaped portion between disks 103, 114 will be overlapped, while a diametrically-opposite portion will be underlapped, so as to expose a larger area opening 115 through which fluid may flow to the return.

Therefore, both forms of the improved jet-deflector amplifier afford the desirable feature of reduced leakage flow of pressurized fluid when the deflector member is in its centered or null position, with power availability when the deflector member is shifted off-null in either direction.

Modifications

The present invention contemplates many changes and modification may be made. For example, while the improved has been shown in the environment of three specific amplifiers, it should be clearly understood that the fundamental principles of the improvement may be applied to other amplifiers as well. For example, while FIGS. 1–3 show a double nozzle-flapper arrangement, the fundamental principles of the improvement could be applied to a single arrangement as well. The shape and configuration of member 40 may be changed or modified as desired, as may be the schematic structure of such a nozzle-flapper arrangement. Similarly, with respect to the jet-pipe arrangement shown in FIGS. 4–6, the sleeve member 62 may be mounted on the jet-pipe so as to be movable relative to the receiver plug or, may be mounted on the receiver plug so as to be stationary with respect to the movable jet-pipe. Moreover, the body may have a separable receiver plug, or may have the structure formed integrally as well.

With respect to the jet-deflector arrangement, the improved device may have two supply ports such that the aggregate opening resembles Siamese twins having two heads and sharing a common body, or may have other shapes and configurations as well. In an arrangement such as shown in FIG. 8, where it is desired to maintain a clearance distance c, suitable means (not shown) would be provided to prevent the deflector member from moving away from the supply openings. The variable-impedance orifice may be operatively positioned between the source(s) and the amplifier, and/or between the amplifier and the return(s), as desired.

Therefore, the invention broadly provides an improved fluid amplifier that is operatively arranged in a flow path extending between a source of pressurized fluid and a fluid return, having at least one fluid connection to a load, and having a movable member operatively arranged to control the pressure at, and flow with respect to, the load. The mechanical member (Le., the flapper, the jet-pipe, the jet-deflector etc.) has a displacement range which encompasses a first or null position and a second or off-null position. The improvement broadly comprises a variable-impedance orifice arranged in series with the amplifier flow path from pressure to return. The impedance of this orifice is varied such that it is a maximum when the mechanical member is in its first or null position, and is reduced or a minimum when the mechanical impute is in a second or off-null position. The flow from the source to the return when the mechanical member is in its null position is substantially less than the maximum flow between the amplifier and load.

Therefore, while various forms of the improved amplifier have been shown and described, and various modifications thereof discussed, persons skilled in this art will readily appreciate that various additional changes and modifications may be made without departing from the spirit of the invention, as defined and differentiated by the following claims.

What is claimed is:

1. In a fluid amplifier having at least one flow path between a source of pressurized fluid and a fluid return, each flow path having at least one fluid connection to a load, at least one nozzle arranged in each flow path, a movable member operatively arranged to divert a portion of the flow through each flow path from the associated nozzle to said load so as to control the pressure at, and flow with respect to, said load, said member being mounted for controlled movement between a null position at which the flow to the load is zero and a displaced position at which the potential flow to the load is a maximum, the total flow from said source to return when said member is in said null position being greater than or equal to the maximum flow to said load when said member is in said displaced position, wherein the improvement comprises:

at least one variable-impedance orifice arranged in each flow path, the impedance of each orifice being varied as a function of the position of said member such that the leakage flow from said source to said return when said member is in said null position will be less than the maximum flow to said load, and the leakage flow from said source to said return when said member is in said displaced position is equal to or greater than the maximum flow to said load;

whereby the total leakage flow when said member is in said null position may be reduced.

2. The improvement as set forth in claim 1 wherein said variable-impedance orifice is operatively arranged between said source and said nozzle.

3. The improvement as set forth in claim 1 wherein said variable-impedance orifice is operatively arranged between said nozzle and return.

4. The improvement as set forth in claim 1 wherein the flow between said source and return when said member is in said first position is less than half of said maximum flow between said amplifier and load.

5. The improvement as set forth in claim 1 wherein said member is a flapper.

6. The improvement as set forth in claim 1 wherein said member is a jet-pipe.

7. The improvement as set forth in claim 1 wherein said member is a jet-deflector.

8. The improvement as set forth in claim 7 wherein said jet-deflector has two fluid inlets communicating with said source, and wherein said member is operatively arranged to cooperate with at least one of said inlets to create said variable-impedance orifice.

9. The improvement as set forth in claim 8 wherein both inlets are substantially closed when said member is in said null position.

10. The improvement as set forth in claim 8 wherein one of said inlets is fully open when said member is in said displaced position.

* * * * *